US007839291B1

(12) United States Patent
Richards

(10) Patent No.: US 7,839,291 B1
(45) Date of Patent: Nov. 23, 2010

(54) WATER SAFETY MONITOR SYSTEMS AND METHODS

(75) Inventor: Austin A. Richards, Santa Barbara, CA (US)

(73) Assignee: Flir Systems, Inc., Wilsonville, OR (US)

( * ) Notice: Subject to any disclaimer, the term of this patent is extended or adjusted under 35 U.S.C. 154(b) by 267 days.

(21) Appl. No.: 11/865,896

(22) Filed: Oct. 2, 2007

(51) Int. Cl.
*G08B 23/00* (2006.01)

(52) U.S. Cl. ..... 340/573.6; 340/553; 348/153; 348/159; 367/93; 367/94

(58) Field of Classification Search ..... 340/573.1, 340/553, 554, 573.6; 348/153, 159; 367/93, 367/94
See application file for complete search history.

(56) References Cited

U.S. PATENT DOCUMENTS 4,932,009 A * 6/1990 Lynch ..... 367/153
5,043,705 A * 8/1991 Rooz et al. ..... 340/573.1
5,563,580 A * 10/1996 Stephens ..... 340/541
5,866,630 A * 2/1999 Mitra et al. ..... 523/118
5,886,630 A * 3/1999 Menoud ..... 340/540
6,097,424 A * 8/2000 Zernov et al. ..... 348/81
6,133,838 A * 10/2000 Meniere ..... 340/573.6
7,123,746 B2 * 10/2006 Meniere et al. ..... 382/103
2002/0057915 A1 * 5/2002 Mann ..... 396/661
2007/0052697 A1 * 3/2007 Cohignac et al. ..... 345/418
2008/0266118 A1 * 10/2008 Pierson et al. ..... 340/573.6

* cited by examiner

*Primary Examiner*—Davetta W Goins
*Assistant Examiner*—Edny Labbees
(74) *Attorney, Agent, or Firm*—Haynes and Boone, LLP

(57) ABSTRACT

Systems and methods are disclosed to monitor a body of water. For example in accordance with an embodiment, a system includes a first camera having a long wave infrared (LWIR) sensor to provide an image data stream of a body of water; means for analyzing the image data stream to determine if a person in the body of water is submerged; and means for providing an alert signal if the person is submerged for more than a specified period of time.

21 Claims, 4 Drawing Sheets

WATER SAFETY MONITOR SYSTEMS AND METHODS

TECHNICAL FIELD

The present invention relates generally to systems and methods for analyzing infrared images and, more particularly, to a system and method for monitoring water safety.

BACKGROUND

Water recreational areas, such as swimming pools, shorelines, docks, water parks and the like can be dangerous places. According to the U.S. Consumer Product Safety Council, for example, each year emergency departments report hundreds of drowning deaths and thousands of near-drowning incidents among children under age 5 years in residential swimming pools in the U.S. Although there are pool alarms that sound off if someone enters the water, those alarms may not detect or monitor normal swimming activity. The alarms may therefore be useful in detecting someone entering the water unexpectedly, but may not be useful in monitoring the pool when people are in the pool doing normal pool or swimming activities.

As a result, there is a need for a water activity monitoring system that can monitor normal water or swimming activities and determine, for example, whether someone has slipped underneath the water and stayed submerged for an unsafe amount of time.

SUMMARY

In general in accordance with one or more embodiments of the present invention, systems and methods are disclosed to monitor a body of water, such as for water safety applications to prevent a drowning (e.g., for humans and other warm-blooded animals). More specifically in accordance with an embodiment of the present invention, a water monitor system includes a camera having an infrared image sensor to provide an image data stream of a body of water; a computer-readable medium having computer-executable components containing instructions for analyzing objects located within the image data stream; a processor adapted to analyze the image data stream in accordance with the computer-executable components to determine whether one of the objects is a person in the body of water submerged for more than a pre-determined period of time.

In accordance with another embodiment of the present invention, a method of monitoring a body of water includes analyzing a data stream from an infrared camera; performing a count of persons in the body of water; maintaining a running tally of persons in the body of water; comparing the running tally to the count; and providing an alert signal when the running tally is greater than the count for a period of time.

In accordance with another embodiment of the present invention, a system includes a first camera having a long wave infrared (LWIR) sensor for providing a first image data stream; a second camera having a very near infrared (VNIR) sensor for providing a second image data stream; a processor adapted to analyze the first and second image data streams in accordance with computer-executable instructions, wherein the computer executable instructions include determining a first number of persons in a body of water from the first image data stream, determining a second number of persons in the body of water from the second image data stream, and comparing the first number with the second number; and wherein the processor is further adapted in accordance with the computer-executable instructions to provide an alert signal when the second number exceeds the first number for a period of time.

In accordance with another embodiment of the present invention, a system includes a first camera having a long wave infrared (LWIR) sensor adapted to provide an image data stream of a body of water; means for analyzing the image data stream to determine if a person in the body of water is submerged; and means for providing an alert signal if the person is submerged for more than a specified period of time.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
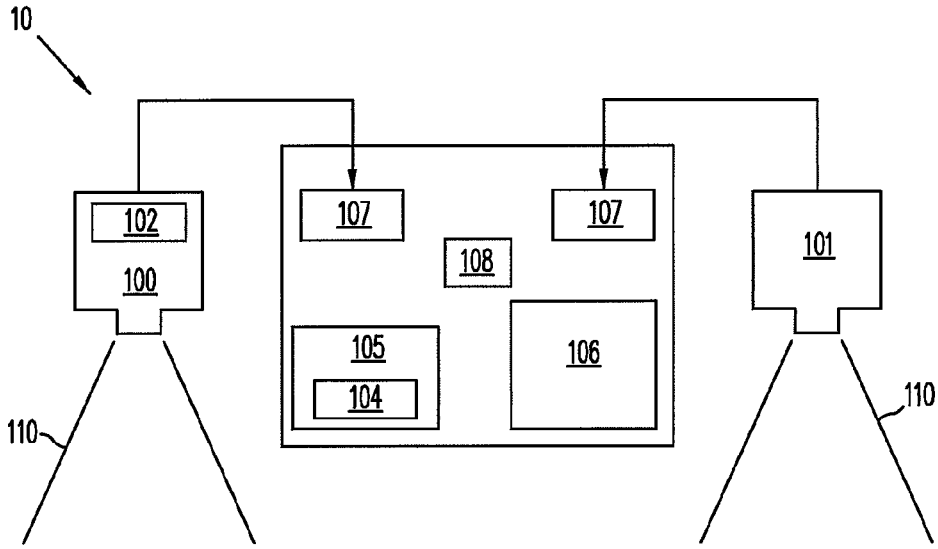
FIG. 1 shows a block diagram illustrating a water safety monitoring system in accordance with an embodiment of the present disclosure.

Systems and methods are disclosed herein to provide a water safety monitor in accordance with one or more embodiments of the present invention. For example, in accordance with an embodiment of the present invention, FIG. 1 shows a water safety monitoring system 10. The system 10 may include at least one camera 100, for example an infrared camera (e.g., long wave infrared (LWIR) camera), having an infrared sensor 102 (e.g., an uncooled microbolometer sensor or other types of infrared sensors). System 10 may also include one or more cameras 101 that operate in a different spectral range, for example the very near infrared (VNIR) waveband or the visible waveband.

System 10 may also include image processing software 104 (e.g., software or other forms of computer executable instructions or configurable logic information) stored, for example, on a computer readable medium 105 (e.g., any type of permanent or portable memory) and a processor 106 for analyzing image data 107 collected from the camera or cameras 100, 101. The processor 106 may run software 104 to analyze data 107 in accordance with software 104 for the purpose of counting and monitoring the number of people within the field of view 110 of camera 100 (and optionally the field of view of camera 101) and providing an alert (e.g., via an alert mechanism 108, such as by visual, auditory, or other electronic means), as discussed in more detail below.

In an example embodiment, software 104 may based on a software package by ObjectVideo (ObjectVideo located in Reston, Va.) or be similar to software implemented by an ObjectVideo software package or other known video or image analysis software. In an example embodiment, features in such a software package may support "tripwire" features, for example monitoring an object moving from one zone to another zone as described below with respect to FIG. 5. Such a software package may also support using threshold conditions or object discrimination, for example, to distinguish non-living objects such as pool toys from living objects to avoid over-counting. A rubber raft may grow warm after exposure to the sun for a period of time and may present an infrared image that mimics that of a person. Programming the software package with threshold factors such as aspect ratio, velocity, or other factors may assist a software package in discriminating images of non-living and/or non-human objects from images of humans. For example, a person jumping into a pool with a raft may initially be counted as a single person. If the raft warms up and separates from the other person, the count may change to include the raft and the person unless threshold factors are applied. Thus, providing threshold values and pre-programming a software package with such discriminating parameters may help prevent over-counting.

Figure 2:
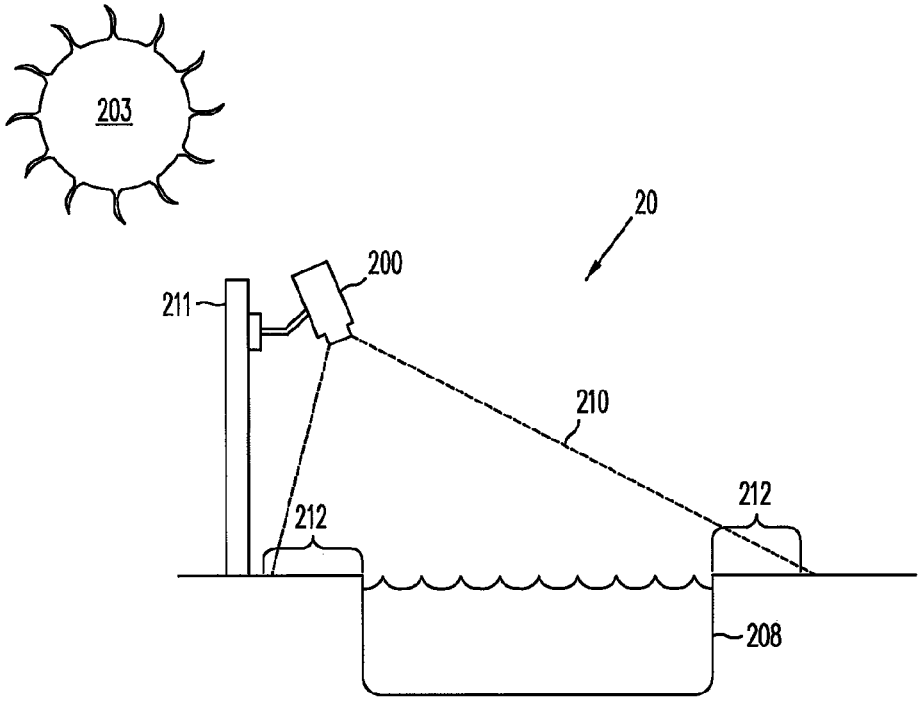
FIG. 2 shows a water safety monitoring system in accordance with an embodiment of the present disclosure.

FIG. 2 illustrates an example embodiment of a water safety monitor system 20 for monitoring water safety at a body of water 208. The body of water 208 may be, for example, a residential pool, hotel pool, spa, hot tub, pond, lake, water park attraction, wading pool, an area of water at a shoreline, an area of water around a dock or float, or any other body of water where persons may be expected to enter water for recreation or other purposes or where monitoring is desired.

A camera 200 (e.g., representing camera 100 or system 10 or some portion of system 10) may be mounted for imaging a body of water 208 and may be arranged so that a body of water 208 is in a field of view 210 of one or more cameras 200. Cameras 200 may be mounted in a position from which they can see the entire body of water 208. This may include mounting camera or cameras 200 on an elevated platform 211, for example a tall mast, pole, and/or nearby building. In the case of a home pool, for example, camera 200 may be mounted on the roof of the home. Camera 200 may be mounted as high as practicable and, for example, may look directly down on or nearly directly down onto the body of water 208 (e.g., viewing the body of water from a "plan view"). Having cameras 200 mounted from one or more elevated platforms 211 and/or from a position which views the body of water from overhead or with a plan view may aid in providing physical separation between multiple people or objects to be imaged and counted by system 20, therefore more likely resulting in an accurate count and less likely to miss people who might otherwise be behind someone else or another object in the camera's field of view 210.

Camera 200 or cameras may be arranged or mounted in a position that minimizes the likelihood or prevents camera 200 from seeing a direct reflection of a sun 203 from the surface of the body of water 208. In the Northern hemisphere, for example, the cameras may be mounted from the southern side of the body of water 208.

In an example embodiment, the field of view may be sufficiently wide to encompass the entire body of water 208 and a boundary zone 212 or area around the outside perimeter of the body of water 208 through which a person would pass before entering or upon exiting the body of water 208. In an example embodiment, the boundary zone 212 may extend up to about two meters from the edge of the body of water 208. Persons of skill in the art may empirically determine a desirable size of such a boundary zone 212 for efficient monitoring, such as depending upon the specific application.

In an example embodiment, camera 200 or cameras may be configured to provide image data 107 to a processor 106 for analysis in accordance with software 104 (FIG. 1) to count, track, and/or monitor the number of people entering or exiting the body of water and monitor safety risks associated with swimming. Monitoring (counting) of the number of people in the body of water may utilize "tripwire" features of the software 104 (FIG. 1) to keep track of persons crossing through the boundary zone 212 into the body of water 208 and from the body of water 208 into the boundary zone 212 as described in more detail herein (e.g., with respect to FIG. 3).

Figure 3:
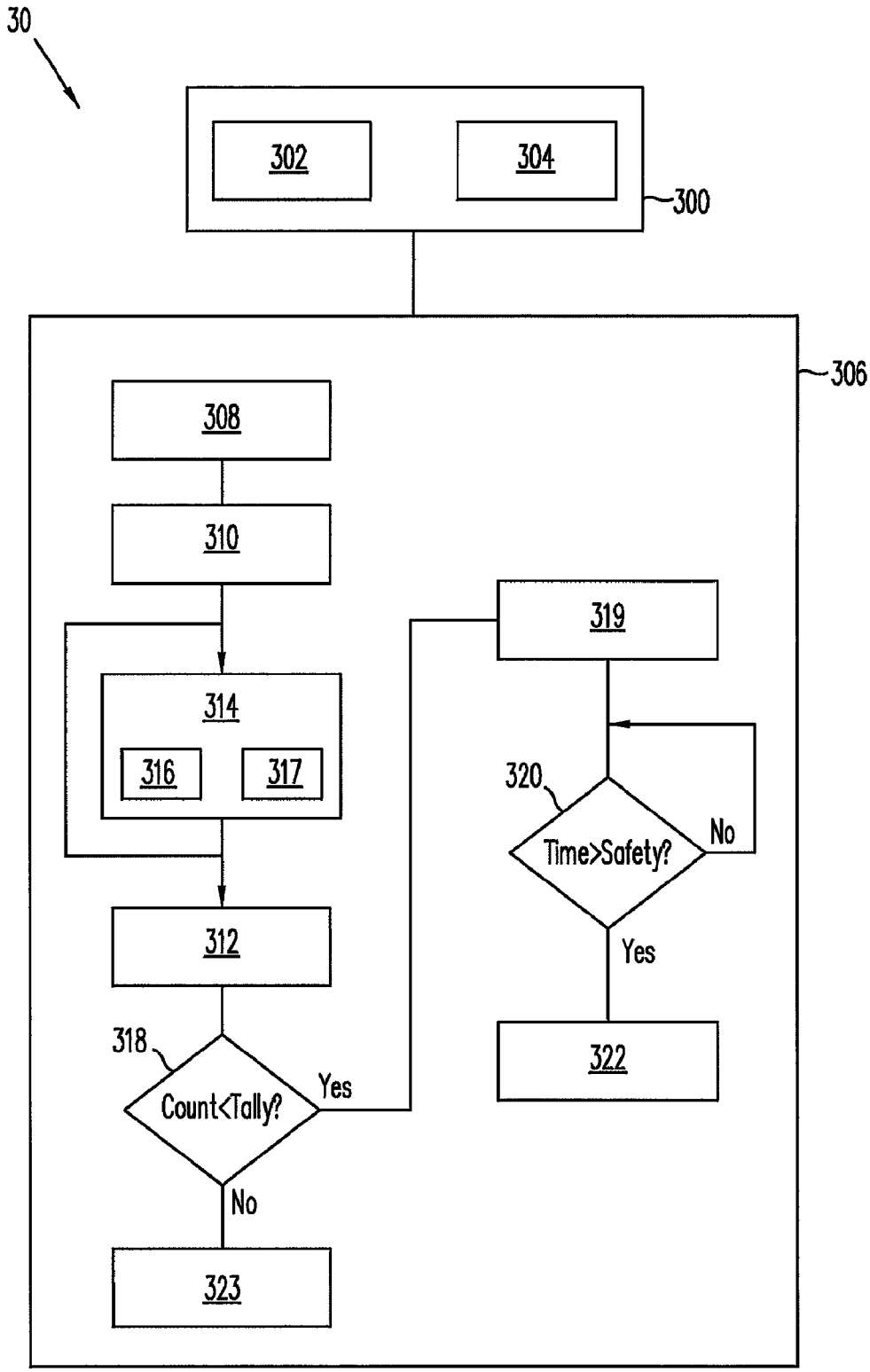
FIG. 3 shows a block diagram of a method of monitoring a body of water in accordance with an embodiment of the present disclosure.

FIG. 3 illustrates a block diagram of an example embodiment of a method 30 of monitoring a body of water. Method 30 may include imaging (block 300) the viewing area, the viewing area including the body of water and optionally a boundary area. Imaging (block 300) the viewing area may include collecting images (block 302) on an infrared sensor in an infrared camera (e.g., camera 100 or 200) to provide an image data stream (block 304) to a processor to be analyzed (e.g., as may be performed by system 10).

The method of monitoring may also include analyzing (block 306) the image data in the processor according to software (e.g., machine executable processing instructions or instructions for configurable logic as determined by configuration bits for a programmable logic device) stored in an electronic form. Analyzing (block 306) the data may include applying threshold conditions (block 308) to the image data for object discrimination. Threshold conditions may be used to prevent or limit the system's monitoring of reflections or other artifacts as people in the body of water and ensure or improve the validity of any counting or monitoring and may help distinguish people from other objects that may enter the pool or the viewing area. Threshold conditions may include, for example, temperature, velocity, shape, and size. Threshold conditions may provide that a bird flying through a camera's field of view, for example, may be ignored, as would a falling leaf or pool toy. A conventional software package (e.g., such as ObjectVideo noted herein) may support such object discrimination and may be pre-programmable with parameters for use as desired in a given application.

In an example embodiment, analyzing (block 306) the data stream may include obtaining an initial count (block 310) of people in the water and updating the count (block 312) periodically. Between counts (blocks 310, 312), the system may keep a running tally (block 314) of people in the body of water by monitoring the number of people entering and/or leaving the body of water (block 316) and updating (block 317) the running tally (block 314) by subtracting one for each person leaving the body of water and adding one for each person entering the body of water (e.g., decrementing and incrementing the running tally count).

Analyzing the data stream (block 306) may further include comparing (block 318) an updated count (block 312) with the running tally (block 314). In an example embodiment using LWIR cameras, any discrepancy may be considered as being due to people under the surface of the body of water when the updated count 312 was made because LWIR radiation from persons under the surface of the water may be absorbed in the water and may not be detected by the camera.

For example, if the system is initialized before anyone enters the water, a first count may indicate that no persons are in the body of water. The tripwire features of the software may count three persons entering the body of water from the boundary zone so that a running tally (block 314) is equal to three. An updated count 312 of persons in the water may indicate two persons in the body of water if one of the persons is below the surface of the water. This would result in a discrepancy of one person, which would be indicative of one person below the surface of the water.

When a discrepancy is first detected, a timer may be started (block 319). If a discrepancy between the continually updated running tally and the periodic updated counts persists for more than a pre-determined time limit or safety time (block 320), an alarm or alert signal may be set off (block 322) to notify people in the vicinity such as a parent or lifeguard that there may be someone in distress who has been submerged for too long. In an example embodiment, the system may activate a pager that may notify a user, for example a parent, who may be indoors or out of hearing range of the audible alarm. The alert signal (block 322) may include visible and/or audible elements such as strobe flashes and an audible tone, so that people with either low vision or hearing could be warned or people who are listening to or looking somewhere else could notice the alert signal (block 322). When the alert signal sounds (block 322), a lifeguard, responsible adult, guardian, and/or other person in the area may perform a visual check of the body of water to verify that people in the body of water are safe or to provide proper aid and assistance. If, on the other hand, an updated count equals the running tally prior to the alert signal (block 322) being set off, the timer may be reset back to zero (block 323) and monitoring continued (e.g., blocks 312, 314, and 318) as normal activity is detected (e.g., normal swimming activity, with no submersions for any extended length of time).

Figure 4:
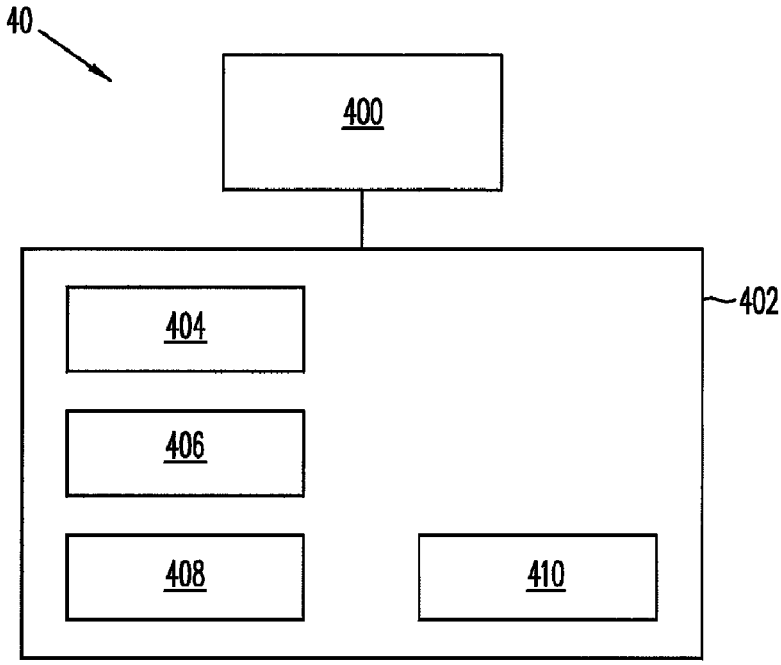
FIG. 4 shows a block diagram of a water safety monitoring system in accordance with an embodiment of the present disclosure.

FIG. 4 illustrates an example embodiment of counting the number of persons in the body of water, for example an initial count 310 or an updated count 312, as described with respect to FIG. 3. In an example embodiment, a counting 40 may include freezing an image from a data stream (block 400). The frozen image may then be analyzed (block 402) and threshold values applied (block 404).

In an example embodiment, the threshold values may include identifying objects above a threshold brightness value, for example to discriminate between people and water (e.g., a person's head may typically be the warmest part of a body). The detected objects above a threshold temperature may be dilated (block 406) to produce a uniform sized object, the uniform sized object corresponding to one person.

Counting 40 may also include eroding the images of people (block 408), for example to separate two people that might be touching (e.g., resulting in the two people becoming two distinct countable "blobs"). Counting 40 may also include summing the number of "blobs" in the image (block 410) or in particular area of the image to provide a count.

Figure 5:
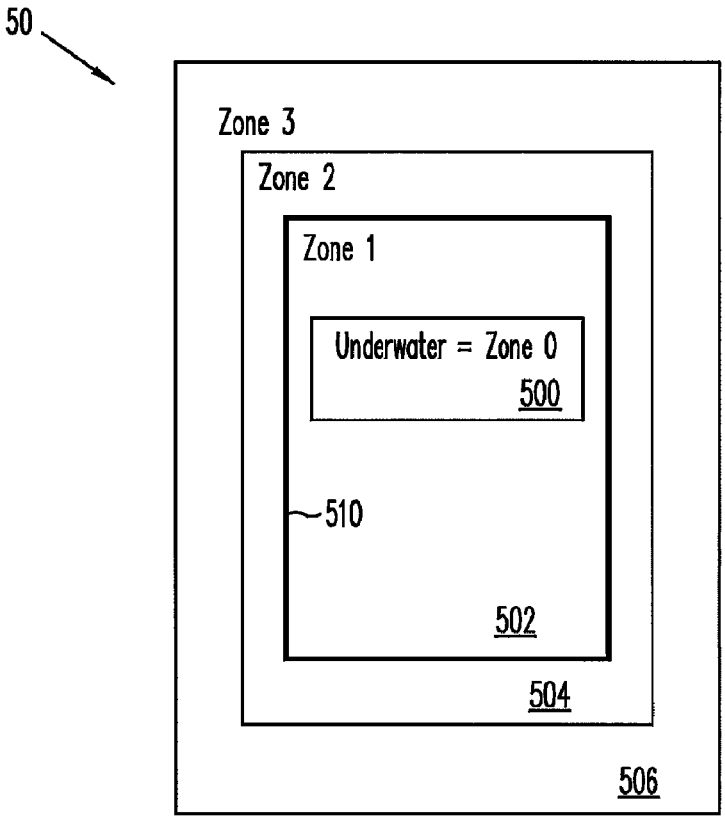
FIG. 5 shows a block diagram of an image of a body of water from a water safety monitoring system in accordance with an embodiment of the present disclosure.

In an example embodiment, image data from a camera (e.g., camera 100 or 200) may be divided into zones of interest for the purpose of keeping the running tally. For example, FIG. 5 illustrates an example embodiment of an image area 50 divided into zones of interest used for keeping the running tally. As shown, the area around and including the body of water may be divided into a plurality of distinct, separate zones for use in analyzing the data and monitoring the body of water. As a convention, the lower the number assigned to a zone, the greater the danger of drowning. The risk may be greatest, for example, in a zone designated as a zone 0 (portion 500), which may designate the portion below the surface of the body of water. Other zones may include a zone 1 (portion 502, which may designate the surface or above the surface of the body of water), a zone 2 (portion 504, which may designate the boundary zone or boundary area immediately adjacent to the body of water), and a zone 3 (portion 506, which may designate the area within the image area 50 and outside the boundary zone 2 (portion 504).

In an example embodiment, the boundary zone 2 (portion 504) may be contiguous with the edge of the body of water and extend, for example, two meters from the edge (e.g., all of the way around the perimeter of the body of water). Zone 3 (portion 506) may extend from the outside boundary of zone 2 (portion 504) to a perimeter fence, for example, or to the outer field of view of the camera(s). As an example, the viewing area of the cameras may be arranged to include at least zone 0 (portion 500) and zone 1 (portion 502) and may further include zone 2 (portion 504) and/or zone 3 (portion 506).

In an example embodiment, at least some of the zones of interest may be separated by one or more boundaries 510, which for example may represent lines of pixels in the image data or "tripwires" extending around a portion or part of the image, such as for example along one of the zones of interest. As a specific example, as a person (or "blobs" representative of people) cross a boundary 510, the system may add or subtract one from the count of people within the area being entered or exited. For example, as a person crosses from zone 1 (portion 502) into zone 2 (portion 504), in other words if the person exits the pool, the running tally may be decreased by one, or vice versa for a person entering into zone 1 (portion 502) from zone 2 (portion 504).

In an example embodiment, a boundary 510 between the two zones may be represented by a line or lines of pixels of at least two pixel lines wide, which may enable a determination of the direction of movement of the object across the boundary (e.g., from zone 1 (portion 502) into zone 2 (portion 504) or vice versa). Specifically, if the object appears at a line of pixels adjacent to zone 1 (portion 502) first, then appears in a line of pixels adjacent to zone 2 (portion 504) second, the direction of travel may be determined as from zone 1 (portion 502) to zone 2 (portion 504). A similar determination may be made with respect to a direction of travel with respect to going from or to any of the adjacent zones, as appropriate, for example by setting appropriate boundaries 510.

In an example embodiment, analyzing the stream of data may include keeping a running tally (e.g., block 314 of FIG. 3) of people in the body of water, for example in zone 1 (portion 502), by monitoring people coming and/or going through zone 2 (portion 504) into or out from the water. This may be done by counting the people entering zone 1 (portion 502) from zone 2 (portion 504) and leaving zone 1 (portion 502) into zone 2 (portion 504) (e.g., keeping a running tally by counting up one for each entrance and by subtracting one for each exit). The system may also periodically and/or regularly count all of the people (e.g., block 312 of FIG. 3) in zone 1 (portion 502), compare the count to the running tally, and determine whether the actual count matches the running tally. Although counts which do not match the tally may be expected from time to time as people are fully submerged below the surface, the discrepancy may be temporary. The number of people in zone 0 (portion 500), in other words under water, may be determined for example by subtracting the number of people in a new count from the running tally as discussed above with respect to FIGS. 3 and 4.

In an example embodiment, analyzing the data stream from camera 100 (or camera 200) may include monitoring the number of people calculated to be in zone 0 (portion 500), in other words determined to be below the surface of the body of water. The number of people in zone 0 (portion 500) may be monitored to determine whether the number of people is greater than zero for more than the threshold period of time (e.g., a "safety time" such as for example sixty seconds). In general as an example, the threshold period of time for zone 0 (portion 500) before sounding an alarm may be selectable and set for a time that is determined to create a risk of drowning. The safety time may be shortened or lengthened as appropriate depending on the desire of the user or based upon the specific monitoring application.

In general for an example embodiment, analyzing the data stream from camera 100 (or camera 200) may further include monitoring the number of people in various zones using the techniques disclosed herein. For example in an embodiment, the system may keep a tally of people in zone 1 (portion 502) by monitoring comings and goings through zone 2 (portion 504, which is the area in which people are entering or exiting the body of water). The system may also directly count all the people in zone 1 (portion 502) on a regular basis and determine if a count can be achieved periodically that matches the tally. There may be counts of zone 1 (portion 502) that may be less than the tally due to a person being fully submerged, but this should be a temporary state. In general, the number of people in zone 0 (portion 500) is the number of people most at risk of drowning, with this count for zone 0 (portion 500) determined for example indirectly by subtracting the zone 1 (portion 502) count from the running tally.

In general, zone 2 (portion 504) is the area in which people are entering or exiting the pool. If a person crosses from zone 2 (portion 504) into zone 1 (portion 502), they are assumed to have entered the body of water and may be "checked in" for example as a pool member (e.g., a person in the body of water) and the zone 1 count (portion 502) may be incremented by 1. If a person crosses from zone 1 (portion 502) to zone 2 (portion 504), they are "checked out" of the pool (e.g., a person no longer in the body of water) and the zone 1 count (portion 502) may be decremented by 1.

As a further example, anyone crossing from zone 3 (portion 506) into zone 2 (portion 504) may be considered to be in a class of people that have the potential to enter the body of water, but that are not at risk of drowning until they enter the body of water. The number of people in zone 2 (portion 504) may be monitored though, because they are at risk of falling into the body of water in a way that a person in zone 3 (portion 506) generally is not. As an example, if the running zone 2 (portion 504) count changes, then that person should have either entered the body of water or crossed into zone 3 (portion 506) or zone 1 (portion 502). Thus, this additional count may be used as a cross-check to make sure all classes of people are being counted correctly. Doing cross checks may also help to reduce the chance of a miscount if one person is sometimes holding another, such as a mother holding a baby. In general as an example, an erosion algorithm (e.g., eroding the images of people as discussed in reference to block 408 of FIG. 4) applied during the counting process may separate the individuals in the resulting image and counted correctly.

As an example in accordance with an embodiment, it will be assumed that three people enter the body of water. Their entrance is noted by counting the people moving from zone 3 (portion 506) to zone 2 (portion 504), and then the people moving from zone 2 (portion 504) to zone 1 (portion 502). The tally in the pool is now three, which may have been determined solely by the movement of people into zone 1 (portion 502) rather than by actually looking into zone 1 (portion 502). A zone 1 (portion 502) count may also be performed periodically (e.g., every two seconds), which may be subtracted from the tally. Under normal swimming conditions, the zone 0 (portion 500) count (e.g., the tally minus the zone 1 (portion 502) count) may be zero, because people normally do not submerge or stay submerged for very long. If two out of the three people in the pool dive underwater, the zone 0 (portion 500) count increases to two. In general, the zone 0 (portion 500) count may be closely monitored to ensure it does not stay at a value greater than zero for more than a determined safety time period (e.g., sixty seconds).

As discussed above with respect to FIG. 1, in an example embodiment, the system may include a camera 101 having a different spectral band than infrared camera 100. The different spectral band may be, for example, the very-near infrared (VNIR) band. Having a second spectral band may provide an additional layer of discrimination. Camera 101, which may provide the different spectral band, may for example be a CCD (charge coupled device) or CMOS (complementary metal oxide semiconductor) based image sensor camera for capturing images digitally in accordance with one or more embodiments.

A VNIR camera may be desirable in that it may be operated at night with a VNIR illuminator. A VNIR illuminator may provide unobtrusive camera visibility without visible light. A VNIR system operating at a wavelength of 780 nm, for example, may be able to see people submerged in water. Such a wavelength may penetrate water to a depth of several meters and return with acceptable levels of attenuation. In an example embodiment, the body of water may be known to be shallower than the maximum penetration depth of the VNIR illumination, in which case, all of the persons within the image may be thought to be in the body of water, either above the water or submerged.

Figure 6:
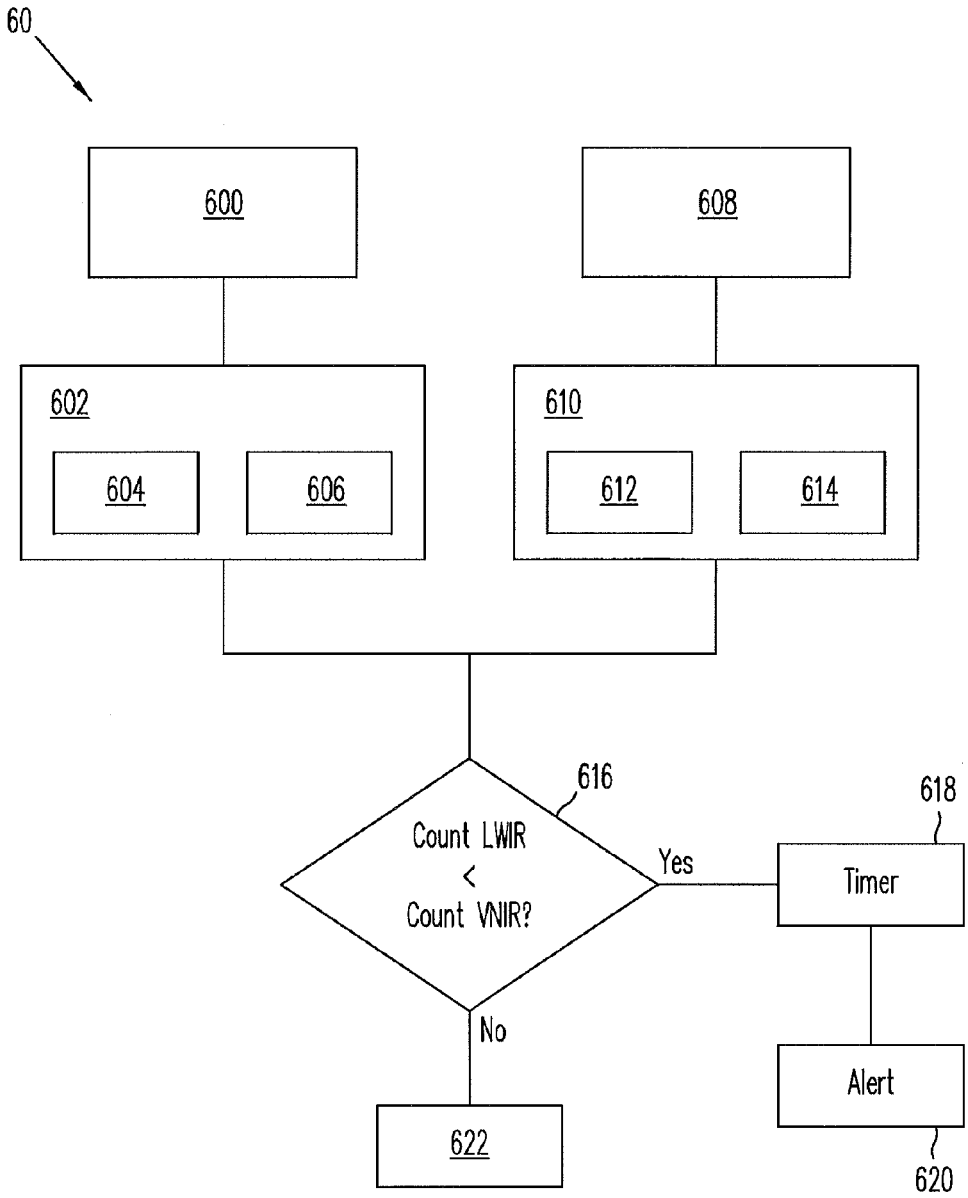
FIG. 6 shows a block diagram of a method of monitoring a body of water in accordance with an embodiment of the present disclosure.

As an example, FIG. 6 illustrates a block diagram example of a method 60 of monitoring water safety using cameras having two different spectral ranges in accordance with an embodiment of the present invention. A camera may monitor a first spectral range (block 600), such as for example infrared or long wave infrared. The camera may, for example, be an uncooled microbolometer camera. A processor may analyze (block 602) an image stream from the camera, for example by applying threshold conditions (block 604) and counting (block 606) a number of people in a zone of the image that may be in the water. The count may correspond to the number of people in the water, but with enough of the body above the surface of the water to be considered as not being under the water.

In an example embodiment, method 60 may also include monitoring (block 608) a second spectral range using a second camera, for example a VNIR camera. A processor may analyze (block 610) a data stream from the second camera, for example by applying threshold conditions (block 612) and counting (block 614) the number of people in the water. The number of people counted in the second camera's data stream may correspond to the number of persons in the body of water, both above the surface and below the surface, at least up to a depth of a few meters.

In an example embodiment, a processor may analyze (blocks 602, 610) the data streams from both cameras. The counts from the different data streams (blocks 606, 614) may be compared (block 616). If a person in the water is counted in both spectral bands, then they may be at least partially above the water, because LWIR generally does not penetrate water more than a few microns deep. If a person is counted only in the VNIR band, then they may likely be submerged. In this manner, a count may be maintained even when people are submerged, and it may be possible to detect each person's submerged state (e.g., the number of people below the surface of the water may correspond to the difference between the count from the second camera and the count from the first camera).

For example, if the above-the-water LWIR count is less than the above-and-below-the-water VNIR count (block 616), a timer may be started (block 618) to determine whether a person has been submerged for too long. If the discrepancy persists for longer than a pre-set safety time, an alert signal may be activated (block 620). If, on the other hand, the discrepancy is resolved before the safety time is reached, the timer may be stopped and reset to zero (block 622).

In general in accordance with one or more embodiments of the present invention, systems and methods are disclosed to provide safety monitoring for a body of water. For example in accordance with one embodiment, a LWIR camera (e.g., having an uncooled microbolometer sensor) may be employed along with image processing software to monitor and count people entering or exiting a swimming pool or other body of water to determine a head count or tally of people in the water. The image processing software, for example, may perform the actual counting based on various thresholding conditions applied to the image data stream (e.g., to avoid identifying reflections or other artifacts as people in the pool and distinguish people from other objects that may enter the pool).

As an example, the thresholding condition criteria may include apparent temperature, velocity, shape, and size. In this manner, a bird flying through the camera's field of view, a falling leaf, or a pool toy may be ignored. The camera or cameras may be mounted in a manner to avoid a direct reflection of the sun off the water surface and to provide proper coverage of the pool and its perimeter.

In general in accordance with an embodiment, the counting of people in the body of water or in a particular zone may be performed as follows. First, the system may freeze an image and then identify objects over a certain threshold (e.g., brightness value and/or other criteria discussed herein to distinguish a person from other objects). The system may then dilate (perform dilating) the objects to produce a uniform sized object corresponding to a person and erode (perform eroding) the images of people (e.g., to separate two people that might be touching) to generate distinct blobs, which may then be counted, as discussed herein.

As an example, the infrared camera may determine if the people in the body of water have at least some part of their body above water. Specifically as an example, the system may count the number of people in a swimming pool and adjust that number as people dive under the surface and re-emerge. If a person stays submerged for more that a predetermined time, the system can sound an alert to notify people in the vicinity to provide aid to the person (or other warm-blooded animal) that has been submerged for too long. As a further example, the system may be able to count people as they move into and out of the various zones, as discussed herein.

In accordance with an embodiment, the infrared camera may provide images based on LWIR, which may provide certain advantages. For example, a LWIR camera may detect a person or warm-blooded animal regardless of lighting conditions, with little sensitivity to reflected light off the water surface (e.g., the amount of solar energy reflected off water is generally low in the LWIR band). Additionally, the LWIR camera may take advantage of the property that LWIR light rays generally do not penetrate through water (e.g., high absorption of water to LWIR light). Thus in general for example, if people are in a swimming pool, they can be seen by a LWIR camera only as long as part of their body is above water and, if they submerge, they become invisible to the camera. Thus, the asymmetry between the appearance of a person above water and a submerged person will enable the system to monitor activity of persons in the body of water and detect if a person has been submerged beyond a safe limit. In contrast, a visible-light camera may count people in a pool, but cannot easily determine if they are submerged or not, because they will be more or less visible even if they are underwater. Furthermore, a visible-light camera may be very prone to seeing reflections off the water surface that can fool a monitoring system's software. A midwave infrared (MWIR) camera may be used, rather than the LWIR camera, as the MWIR camera may also offer the ability to image people regardless of lighting conditions, but the MWIR camera relative to the LWIR camera may be more expensive, maintenance intensive, and more sensitive to imaging sun glints that may fool a system used during the day (e.g., when most people may swim).

Embodiments described above illustrate but do not limit the invention. It should also be understood that numerous modifications and variations are possible in accordance with the principles of the present invention. Accordingly, the scope of the invention is defined only by the following claims.

What is claimed is:

1. A water monitor system comprising:

a camera having an infrared image sensor to provide an image data stream of a surface of a body of water;

a computer-readable medium having computer-executable components containing instructions for analyzing objects located within the image data stream; and a processor adapted to analyze the image data stream in accordance with the computer-executable components to determine whether one of the objects is a person in the body of water submerged for more than a predetermined period of time by:

counting how many people are at the surface of the body of water based on the image data stream to form a count;

maintaining a running tally of how many people are in the body of water based on the image data stream; and comparing the running tally to the count to determine whether a person in the body of water is submerged for more than the predetermined period of time.

2. The water monitor system of claim 1, wherein the camera is a long wave infrared camera and has an overhead view of the body of water.

3. The water monitor system of claim 1, wherein the processor is further adapted to analyze the image data stream in accordance with the computer-executable components to perform a process for the counting comprising:

freezing an image from the image data stream;

applying threshold values to the frozen image;

dilating detected persons in the frozen image;

eroding images of the detected persons; and counting a number of the detected persons.

4. The water monitor system of claim 1, wherein the processor is further adapted to analyze the image data stream in accordance with the computer-executable components and, based on the comparing, activating an alert signal when a result of the comparing indicates that a person in the body of water is submerged for more than the predetermined period of time.

5. The water monitor system of claim 4, wherein the counting further comprises:

freezing an image from the data stream;

applying threshold values;

dilating detected persons based on the applying;

eroding the detected persons; and performing a summation of the number of detected persons in the body of water.

6. The water monitor system of claim 4, wherein the maintaining further comprises:

determining an initial number of persons in the body of water;

monitoring a person entering the body of water from a boundary zone and incrementing the running tally by one; and monitoring a person exiting the body of water and crossing into the boundary zone and decrementing the running tally by one.

7. The water monitor system of claim 1, wherein the processor is adapted to analyze the image data stream in accordance with the computer-executable components to perform a process for the counting, the maintaining, and the comparing comprising:

determining an initial number of persons in the body of water;

updating the running tally based on the initial number of persons and the number of persons entering the body of water from a boundary zone around a perimeter of the body of water and exiting the body of water and crossing into the boundary zone;

determining a number of persons at the surface of the body of water by counting a second number of persons in a second image; and comparing the second number of persons in the second image with the running tally, wherein a discrepancy between the running tally and the subsequent number of persons corresponds to a submerged person.

8. The water monitor system of claim 1, further comprising a second camera having a very near infrared (VNIR) sensor for providing a second image data stream of the body of water, and wherein the processor is further adapted to analyze the image data stream and the second image data stream in accordance with the computer-executable components to perform a process comprising:

counting a second number of persons in the body of water using the second image data stream from the second camera; and comparing the count with the second number, wherein a person is determined to be submerged if there is a difference between the count and the second number.

9. A method of monitoring a body of water comprising:

analyzing a data stream from an infrared camera;

performing a count of persons at a surface of the body of water based on the analyzing;

maintaining a running tally of persons in the body of water based on the analyzing;

comparing the running tally to the count; and providing an alert signal when the running tally is greater than the count for a period of time.

10. The method of claim 9, wherein the performing the count comprises:

freezing an image from the data stream;

applying threshold conditions to objects in the image;

dilating detected persons in the image;

eroding the detected persons in the image; and counting a number of persons at the surface of the body of water.

11. The method of claim 9, wherein the maintaining the running tally comprises:

counting an initial number of persons in the body of water;

incrementing the running tally by one for each person entering the body of water from a boundary zone around a perimeter of the body of water; and decrementing the running tally by one for each person exiting the body of water and entering into the boundary zone.

12. The method of claim 11, wherein the maintaining the running tally further includes using a tripwire function between the body of water and the boundary zone.

13. The method of claim 11, wherein images in the data stream are divided into zones including a first zone corresponding to the body of water and a second zone corresponding to the boundary zone, and wherein the first zone and the second zone are separated by a line of pixels that are at least two pixels wide.

14. The method of claim 9, wherein the providing the alert signal includes providing a visible signal and an audible signal.

15. The method of claim 9, wherein the period of time corresponds to a predetermined safety time limit.

16. The method of claim 9, wherein the infrared camera comprises a long wave infrared (LWIR) sensor and wherein the analyzing further comprises analyzing a second data stream from a second camera having a very near infrared (VNIR) sensor, and wherein the method further comprises:

performing a second count of persons in the body of water using the second data stream;

comparing the count to the second count; and providing the alert signal when the comparing indicates the second count is greater than the count for a period of time in excess of a predetermined safety time period.

17. A system comprising:

a first camera having a long wave infrared (LWIR) sensor adapted to provide an image data stream of a surface of a body of water and at least one region comprising a boundary zone along at least a portion of the body of water;

a processor adapted to analyze the image data stream to determine if a person in the body of water is submerged by performing a process comprising:

determining from the image data stream if a person enters or leaves the body of water via the boundary zone;

maintaining a running tally of the number of persons in the body of water based on the determining;

performing a count of persons above the surface of the body of water based on the image data stream;

comparing the running tally with the count to determine if a person in the body of water is submerged; and providing an alert signal if a person is submerged for more than a specified period of time.

18. The system of claim 17, further comprising:

a second camera having a very near infrared (VNIR) sensor adapted to provide a second image data stream of the body of water; and wherein the processor is further adapted to analyze the second image data stream in comparison to the image data stream of the first camera to determine if a person in the body of water is submerged.

19. The system of claim 17, wherein the performing the count comprises:

freezing an image from the image data stream to provide a frozen image;

applying threshold values to the frozen image;

dilating detected persons in the frozen image;

eroding images of the detected persons; and counting a number of the detected persons to provide the count.

20. The system of claim 17, wherein the determining is based on a tripwire associated with the boundary zone.

21. The system of claim 20, wherein the boundary zone comprises a plurality of boundary zones with associated tripwires.

* * * * *